US006712663B2

(12) United States Patent
Jo

(10) Patent No.: US 6,712,663 B2
(45) Date of Patent: Mar. 30, 2004

(54) METHOD OF MANUFACTURING PLASMA-DISPLAY-PANEL-SUBSTRATE, PLASMA-DISPLAY-PANEL-SUBSTRATE, AND PLASMA DISPLAY PANEL

(75) Inventor: Keisuke Jo, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/870,471

(22) Filed: Jun. 1, 2001

(65) Prior Publication Data

US 2001/0052753 A1 Dec. 20, 2001

(30) Foreign Application Priority Data

Jun. 2, 2000 (JP) ..... P2000-165820
Apr. 25, 2001 (JP) ..... P2001-127794

(51) Int. Cl.[7] ..... H01J 9/24
(52) U.S. Cl. ..... 445/24
(58) Field of Search ..... 445/24

(56) References Cited

U.S. PATENT DOCUMENTS 6,031,329 A 2/2000 Nagano
6,103,452 A * 8/2000 Kakinuma et al. ..... 430/281.1
6,137,226 A 10/2000 Nagano
6,512,329 B1 * 1/2003 Mitsutake et al. ..... 313/495

FOREIGN PATENT DOCUMENTS

| | | |
|---|---|---|
| JP | 5190099 | 7/1993 |
| JP | 05-314913 | 11/1993 |
| JP | 07-262930 | 10/1995 |
| JP | 9-102280 | 4/1997 |
| JP | 2000-39866 | 2/2000 |
| JP | 2000-156166 A | 6/2000 |
| JP | 2001-028242 | 1/2001 |

* cited by examiner

*Primary Examiner*—Kenneth J. Ramsey
(74) *Attorney, Agent, or Firm*—Birch, Stewart, Kolasch & Birch, LLP

(57) ABSTRACT

A discharge inhibiting film is formed in an area corresponding to a space defined between adjacent electrode pairs on a surface of a cathode film of a front panel. The discharge inhibiting film is formed by a process using a paste, such as a printing process. The paste comprises, for example, a kneaded mixture of: (a) a powder of discharge inhibiting material such as $TiO_2$ and $Al_2O_3$; (b) a glass powder such as PbO; (c) a resin such as ethyl cellulose; and (d) an organic solvent such as terpineol. The powders used here are not greater than 1 $\mu$m in average particle size. Further, for example, the viscosity of the paste is controlled to, e.g., 30 to 100 Pa·s. Such a paste is printed, dried and fired to produce the discharge inhibiting film.

11 Claims, 9 Drawing Sheets

METHOD OF MANUFACTURING PLASMA-DISPLAY-PANEL-SUBSTRATE, PLASMA-DISPLAY-PANEL-SUBSTRATE, AND PLASMA DISPLAY PANEL

BACKGROUND OF THE INVENTION

1. Field of the Invention

The present invention relates to a plasma display panel (referred to hereinafter as a "PDP"), a PDP-substrate, and a method of manufacturing the PDP-substrate. More particularly, the invention relates to a technique for reducing the costs of a PDP and a PDP-substrate, and a technique for improving the brightness or the display quality of the PDP.

2. Description of the Background Art

With the recent trend toward higher definition for PDPs, display cells (referred to also simply as "cells") of the PDPs have become finer. The display cells are also referred to as "discharge cells" or "light emitting cells." As an electrode-to-electrode spacing, or a region between adjacent cells, becomes smaller because of the finer cells, discharge (erroneous discharge) becomes prone to occur in the region which is not associated with display. One of the methods of preventing such erroneous discharge in surface discharge type PDPs is disclosed in, for example, Japanese Patent Application Laid-Open No. 9-102280 (1997). This discloses the technique of providing a film for suppressing erroneous discharge on a cathode film of a surface discharge type PDP, the film being formed by patterning titanium oxide ($TiO_2$) or aluminum oxide ($Al_2O_3$) using an evaporation and lift-off process.

However, the evaporation and lift-off process involves a relatively large number of process steps to increase costs. More specifically, the evaporation and lift-off process comprises a series of process steps: (i) coating of a resist; (ii) pattern exposure of the resist; (iii) development of the resist; (iv) evaporation of $TiO_2$ or the like; and (v) removal of the resist, and accordingly requires manufacturing apparatuses for the respective process steps. This adds to the costs such as an apparatus cost and a maintenance cost of the manufacturing apparatuses, resulting in an increased costs of the PDPs.

SUMMARY OF THE INVENTION

A first aspect of the present invention is intended for a method of manufacturing a plasma-display-panel-substrate including a discharge inhibitor disposed on a surface of a substrate having electrodes for inhibiting formation of discharge in a plasma display panel. According to the present invention, the method comprises the steps of: (a) placing a paste for the discharge inhibitor on the surface of the substrate having the electrodes; and (b) firing the paste to form the discharge inhibitor.

According to a second aspect of the present invention, in the method of the first aspect, the paste comprises a discharge inhibiting material having an average particle size of not greater than about 1 $\mu$m.

According to a third aspect of the present invention, in the method of the first or second aspect, the step (a) comprises the step of placing the paste by a printing process.

According to a fourth aspect of the present invention, in the method of the first or second aspect, the step (a) comprises the step of placing the paste by a dispenser process.

According to a fifth aspect of the present invention, in the method of the first or second aspect, the step (a) comprises the step of placing the paste by a coater.

According to a sixth aspect of the present invention, the method of the first or second aspect further comprises the step of (c) placing the paste on a predetermined sheet and drying the paste to form a dry film, wherein the step (a) comprises the step of placing the paste in the form of the dry film.

According to a seventh aspect of the present invention, in the method of the first or second aspect, the step (a) comprises the step of patterning the paste by a photolithographic process.

According to an eighth aspect of the present invention, the method of any one of the first to seventh aspects further comprises the step of (d) forming a cathode film on the surface of the substrate having the electrodes, wherein the step (d) is performed as a final step.

According to a ninth aspect of the present invention, a plasma-display-panel-substrate comprises: a substrate having electrodes; and a discharge inhibitor disposed on a surface of the substrate having the electrodes for inhibiting formation of discharge in a plasma display panel, wherein the plasma-display-panel-substrate is manufactured by a manufacturing method comprising the steps of: (a) placing a paste for the discharge inhibitor on the surface of the substrate having the electrodes; and (b) firing the paste to form the discharge inhibitor.

According to a tenth aspect of the present invention, in the plasma-display-panel-substrate of the ninth aspect, the discharge inhibitor is disposed in a lattice pattern on the surface of the substrate having the electrodes.

According to an eleventh aspect of the present invention, in the plasma-display-panel-substrate of the ninth aspect, the discharge inhibitor is black, white or transparent.

According to a twelfth aspect of the present invention, in the plasma-display-panel-substrate of any one of the ninth to eleventh aspects, the plasma display panel comprises a plurality of display cells, and the discharge inhibitor is disposed in an area corresponding to a space defined between adjacent ones of the display cells.

According to a thirteenth aspect of the present invention, a plasma display panel comprises: a first substrate; and a second substrate disposed in face-to-face relationship with the first substrate, wherein the second substrate comprises: a substrate having electrodes; and a discharge inhibitor disposed on a surface of the substrate having the electrodes for inhibiting formation of discharge in the plasma display panel, and wherein the second substrate is manufactured by a manufacturing method comprising the steps of: (a) placing a paste for the discharge inhibitor on the surface of the substrate having the electrodes; and (b) firing the paste to form the discharge inhibitor.

According to a fourteenth aspect of the present invention, a plasma display panel comprises: a first substrate having a barrier rib; and a second substrate disposed in face-to-face abutting engagement with the barrier rib, wherein part of a surface of the second substrate which is to be in abutting engagement with the barrier rib is in an unsintered state.

In the method according to the first aspect of the present invention, the discharge inhibitor is formed using the paste. The paste may be placed by using, for example, a printing process, a dispenser process or a coater. Alternatively, the paste may be placed after it is dried to form a dry film. The use of the paste increases the flexibility of the method of forming the discharge inhibitor.

Additionally, placing the paste by the above-mentioned processes reduces costs such as an apparatus cost and a maintenance cost of manufacturing apparatuses, as compared with an evaporation and lift-off process. Moreover, patterning the discharge inhibitor by using, for example, a pattern printing process or a dispenser process reduces the number of process steps, as compared with the evaporation and lift-off process. Consequently, the method of the first aspect of the present invention can manufacture the plasma-display-panel-substrate (PDP-substrate) and, therefore, the PDP at low costs.

The method according to the second aspect of the present invention can form the thin-film discharge inhibitor by a process using the paste. Then, such a thin-film discharge inhibitor can ensure isolation between cells. Further, the use of the discharge inhibiting material smaller in particle size makes the discharge inhibitor more transparent, thereby to provide higher light output efficiency.

The method according to the third aspect of the present invention can reduce the time required to form the discharge inhibitor, as compared with the evaporation and lift-off process, to manufacture the PDP-substrate and, therefore, the PDP at lower costs than can the evaporation and lift-off process.

The method according to the fourth aspect of the present invention can directly draw the discharge inhibitor without using a photolithographic process by using, for example, a nozzle which conforms to the pattern width of the discharge inhibitor. Further, the dispenser process is very high in efficiency of utilization of the paste. Therefore, the method according to the fourth aspect can manufacture the PDP-substrate and, therefore, the PDP at lower costs than can the evaporation and lift-off process.

The method according to the fifth aspect of the present invention can place the paste with a more uniform thickness (with variations in film thickness suppressed) than can the printing process even if a printing surface has a large area. Furthermore, although the printing process is disadvantageous in that mesh marks of a screen are left as surface irregularities, the coater can avoid such irregularities.

The method according to the sixth aspect of the present invention can reduce the time required to form the discharge inhibitor, as compared with not only the evaporation and lift-off process but also the printing process and the like. Therefore, the method according to the sixth aspect of the present invention can manufacture the PDP-substrate and, therefore, the PDP at lower costs than can the evaporation and lift-off process and the like.

According to the seventh aspect of the present invention, patterning in the photolithographic process is better in rectilinear property of pattern edges and in position accuracy with respect to electrodes than the pattern printing process, and therefore is more advantageous in process margin.

According to the eighth aspect of the present invention, the cathode film is formed in the final step of the method of manufacturing the PDP-substrate. In other words, this method does not perform the step of forming other components (e.g. the discharge inhibitor) after the cathode film is formed. This prevents the deterioration of film quality of the cathode film. Therefore, the method according to the eighth aspect of the present invention can manufacture the PDP-substrate which can achieve a PDP of high display quality having the good-quality cathode film.

The ninth aspect of the present invention produces the effects of any one of the above-mentioned first to eighth aspects to provide an inexpensive PDP-substrate and, therefore, an inexpensive PDP.

According to the tenth aspect of the present invention, since the PDP-substrate comprises the discharge inhibitor in the lattice pattern, the discharge inhibitor may be disposed between adjacent display cells in the PDP and abut against a barrier rib. The abutment allows the discharge inhibitor to close a clearance between the barrier rib and the PDP-substrate. This prevents leakage of discharge through the clearance, to ensure isolation between adjacent cells, thereby improving image quality. Such an effect is also produced if the discharge inhibitor is thick.

According to the eleventh aspect of the present invention, coloring the discharge inhibitor black provides the PDP-substrate which can improve PDP contrast.

Alternatively, the discharge inhibitor, if colored white, can reflect light generated in the display cells of the PDP. The reflected light may be repeatedly reflected within the cells and finally led out of the PDP. This improves the brightness of the PDP, that is, provides the PDP-substrate which achieves the high-brightness PDP.

Further, the discharge inhibitor, if made transparent, can lead the light generated in the display cells out of the PDP therethrough. This provides the PDP-substrate which achieves the high-brightness PDP.

According to the twelfth aspect of the present invention, the discharge inhibitor can suppress discharge (erroneous discharge) between adjacent display cells. This provides the PDP having high display quality.

The thirteenth aspect of the present invention produces the effects of any one of the above-mentioned ninth to twelfth aspects to provide an inexpensive PDP having excellent display quality (image quality) and the like.

The fourteenth aspect of the present invention can prevent damages to the barrier rib to suppress the occurrence of pixel defects in the PDP.

It is therefore a primary object of the present invention to provide a method of manufacturing a PDP-substrate which can achieve cost reduction of the PDP-substrate and a PDP.

It is another object of the present invention to provide a PDP-substrate capable of improving the brightness or display quality of a PDP, and to provide a high-brightness, high-display-quality PDP using such a PDP-substrate.

These and other objects, features, aspects and advantages of the present invention will become more apparent from the following detailed description of the present invention when taken in conjunction with the accompanying drawings.

DESCRIPTION OF THE PREFERRED EMBODIMENTS

<First Preferred Embodiment>

Figure 1:
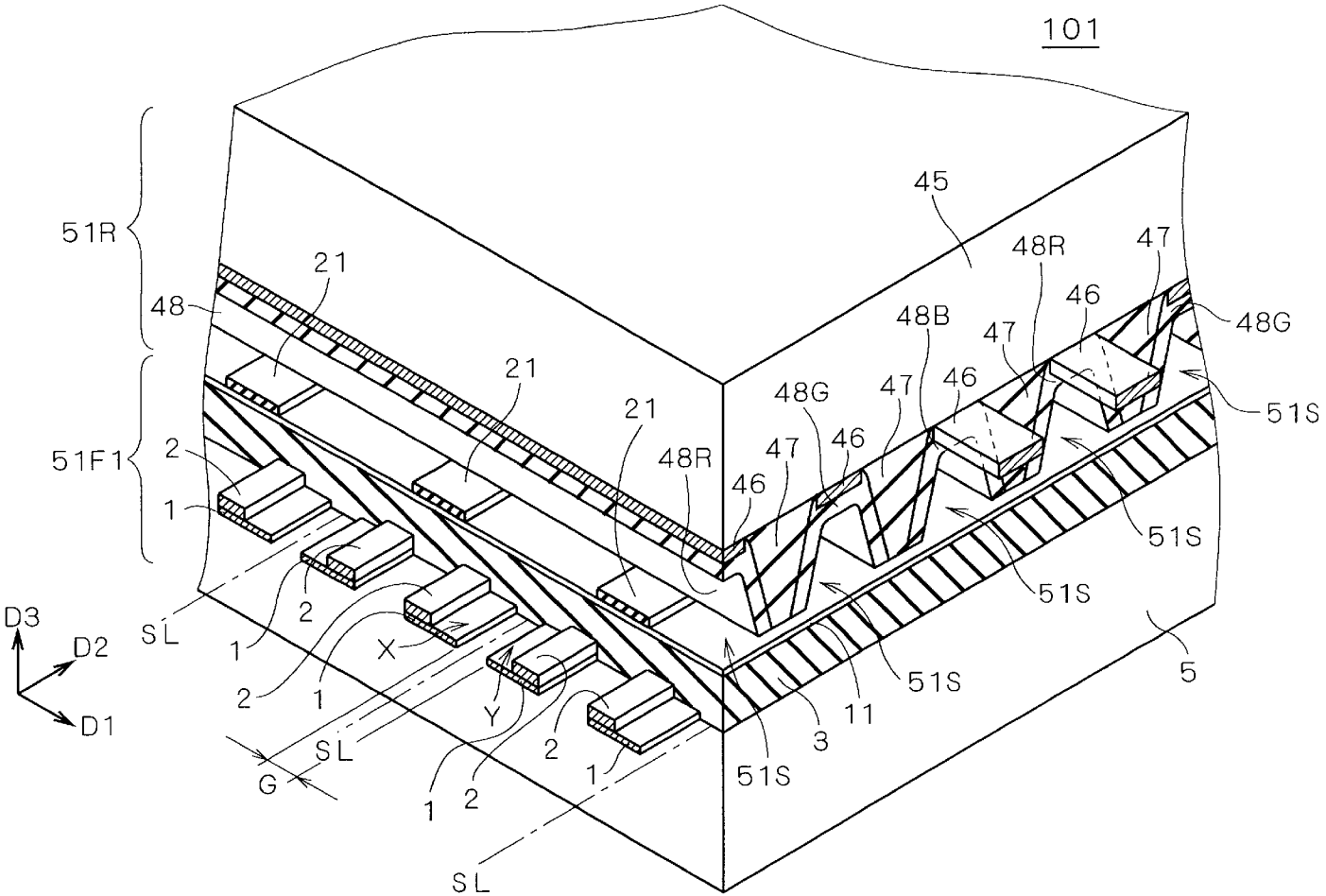
FIG. 1 a schematic perspective view of a plasma display panel according to a first preferred embodiment of the present invention.
Figure 2:
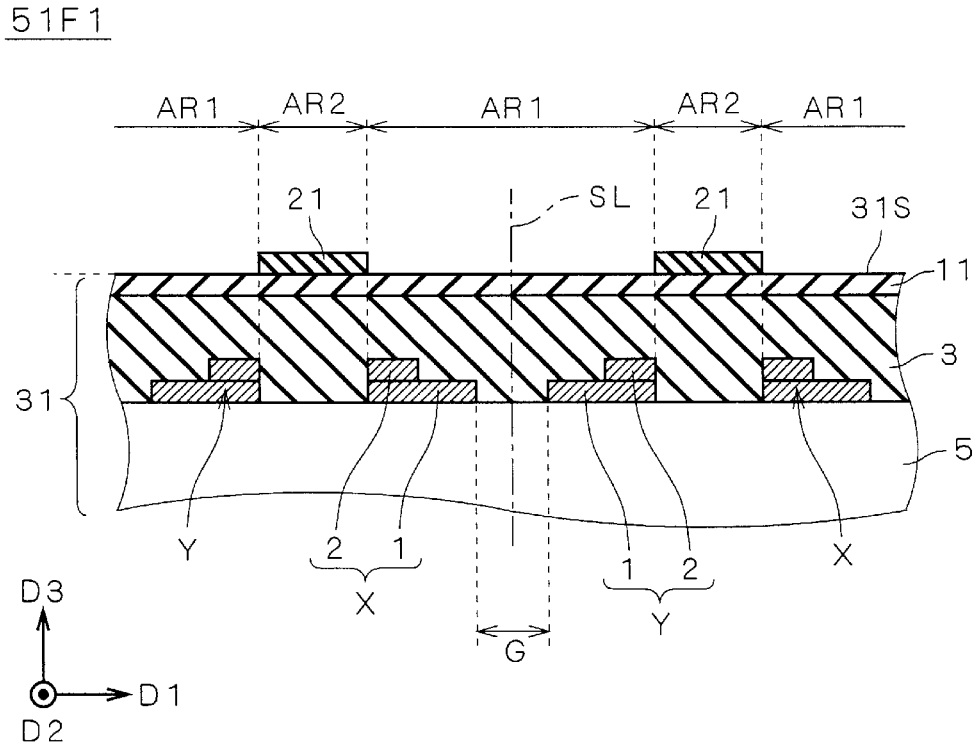
FIG. 2 is a schematic sectional view of a front panel according to the first preferred embodiment.
Figure 3:
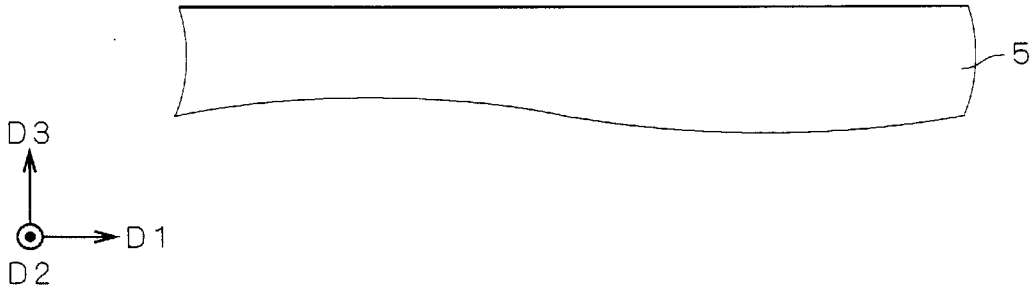
FIGS. 3 through 7 are schematic sectional views for illustrating a method of manufacturing the front panel according to the first preferred embodiment.

FIG. 1 is a schematic perspective view of a PDP 101 according to a first preferred embodiment of the present invention. FIG. 2 is a schematic sectional view of a front panel (also referred to as a PDP-substrate or a second substrate) 51F1 of the PDP 101. As shown in FIG. 1, the PDP 101 comprises the front panel 51F1 and a rear panel 51R (or a first substrate) 51R arranged in overlying or stacked relation in a third direction D3. The front panel 51F1 will be described first.

Referring to FIG. 2, the front panel 51F1 comprises: (A) a substrate 31 having discharge sustain electrodes (referred to also simply as "electrodes") X and discharge sustain electrodes (or electrodes) Y; and (B) colored or transparent discharge inhibiting films (or a discharge inhibitor) 21 disposed on a surface 31S of the substrate 31 on the rear panel 51R side. The term "colored" as used herein shall include black and white, and the term "transparent" shall mean being permeable or transmissive to visible light, which will be described in detail later with respect to a fourth preferred embodiment.

The discharge inhibiting film is also referred to as a "discharge deactivating film" (e.g., in U.S. Pat. No. 6,137,226), as a "discharge passivation film" (e.g., in U.S. Pat. No. 6,031,329) or as a "discharge inert film" (e.g., in U.S. patent application Ser. No. 09/635,709).

The substrate 31 comprises a front glass substrate 5, the electrodes X and Y, a dielectric layer 3, and a cathode film 11. More specifically, the plurality of strip-shaped electrodes X and Y each extending in a second direction D2 perpendicular to the third direction D3 are disposed in a striped pattern on a main surface of the front glass substrate 5 on the rear panel 51R side. The electrodes X and Y alternate with each other, and a pair of electrodes X and Y (referred to also as an "electrode pair X, Y") adjacent to each other on opposite sides of a discharge gap G correspond to a scanning line SL. Each of the electrodes X and Y comprises a strip-shaped transparent electrode 1 disposed on the main surface of the front glass substrate 5 and extending in the second direction D2, and a metal electrode or bus electrode 2 disposed on the transparent electrode 1 and extending in the second direction D2 (and accordingly along the transparent electrode 1). The bus electrodes 2 of each electrode pair X, Y are disposed on the far side from each other or from the discharge gap G.

The dielectric layer 3 is disposed to cover the electrodes X, Y and the front glass substrate 5, and the cathode film 11 is disposed on a surface of the dielectric layer 3 on the rear panel 51R side. The cathode film 11 is made of a material having a high coefficient of electron emission, such as MgO, that is, a material capable of functioning as a discharge cathode. A surface of the cathode film 11 on the rear panel 51R side corresponds to the surface 31S of the substrate 31.

The plurality of strip-shaped discharge inhibiting films 21 each extending in the second direction D2 are disposed on the surface 31S. In particular, the discharge inhibiting films 21 comprise a material having a lower coefficient of electron emission than that of the cathode film 11, that is, a material difficult to function as the discharge cathode (such a material is referred to hereinafter as a "discharge inhibiting material"), and have a less function as a cathode than does the cathode film 11. Examples of the discharge inhibiting material include titanium oxide ($TiO_2$) and aluminum oxide ($Al_2O_3$).

In particular, the discharge inhibiting films 21 are formed by a printing process using paste (to be described later), and are thin films having a thickness of about 1.6 to about 2 $\mu$m. The pattern width (or a dimension measured in a first direction D1 perpendicular to the second and third directions D2 and D3) of the discharge inhibiting films 21 is, for example, not greater than 300 $\mu$m.

Each of the discharge inhibiting films 21 is disposed in an area AR2 between adjacent electrode pairs X, Y (or an area between (display) cells arranged in the first direction D1) on the surface 31S. The area AR2 used herein shall include not only a two-dimensional area between adjacent electrode pairs X, Y on the main surface of the front glass substrate 5 but also a three-dimensional area defined by extending the two-dimensional area in the third direction D3. The front panel 51F1 is roughly divided into the area AR2 and an area AR1 other than the area AR2.

Although an area in which the discharge inhibiting films 21 are present (or exposed) as seen in plan view of the surface 31S is shown in FIG. 2 in non-overlapping relationship with the electrodes X and Y, the discharge inhibiting films 21 may be extended outwardly from the area AR2 in the first direction D1 so that the above-mentioned area overlaps the electrodes X and/or the electrodes Y (see Japanese Patent Application Laid-Open No. 9-102280 described above). In such a case, each of the discharge inhibiting films 21 is disposed in the area including the area AR2. Conversely, each of the discharge inhibiting films 21 is disposed partially within the area AR2. The same is true for discharge inhibiting films 22, 23 and 25 to be described later.

Referring again to FIG. 1, the rear panel 51R comprises a rear glass substrate 45. A plurality of strip-shaped address electrodes (referred to also simply as "electrodes") 46 each extending in the first direction D1 are disposed in a striped pattern on a main surface of the rear glass substrate 45 on the front panel 51F1 side. Barrier ribs 47 each extending in the first direction D1 are formed between adjacent ones of the electrodes 46 on the main surface of the rear glass substrate 45. The top of each barrier rib 47 on the front panel 51F1 side may be colored black to improve contrast.

Phosphor layers 48 are disposed on the inner surface of generally U-shaped grooves defined by the barrier ribs 47 and the rear glass substrate 45 to cover the electrodes 46. In FIG. 1, red-emitting, green-emitting and blue-emitting phosphor layers 48 are designated by the reference characters 48R, 48G and 48B, respectively.

The front panel 51F1 and the rear panel 51R are disposed so that the discharge inhibiting films 21 and the barrier ribs 47 are in abutting engagement with each other, and are then sealed together at their peripheries not shown. Spaces defined by the U-shaped grooves or the phosphor layers 48 and each extending in the first direction D1 form respective discharge spaces 51S. The discharge spaces 51S are filled with a discharge gas comprising, for example, neon (Ne) and xenon (Xe).

A rear panel having a different structure may be used in place of the rear panel 51R for combination with the front panel 51F1. The same is true for a first modification of the first preferred embodiment to be described later and the like.

The PDP 101 has a plurality of cells arranged in a matrix and each defined by a point of three-dimensional intersection of one of the electrode pairs X, Y (or one of the scanning lines SL) and one of the electrodes 46. Then, the discharge inhibiting films 21 are disposed between the scanning lines SL or between the cells arranged in the first direction D1.

Next, description will now be given on a method of manufacturing the front panel 51F1 with reference to schematic sectional views of FIGS. 3 through 7 in addition to FIGS. 1 and 2.

Figure 4:
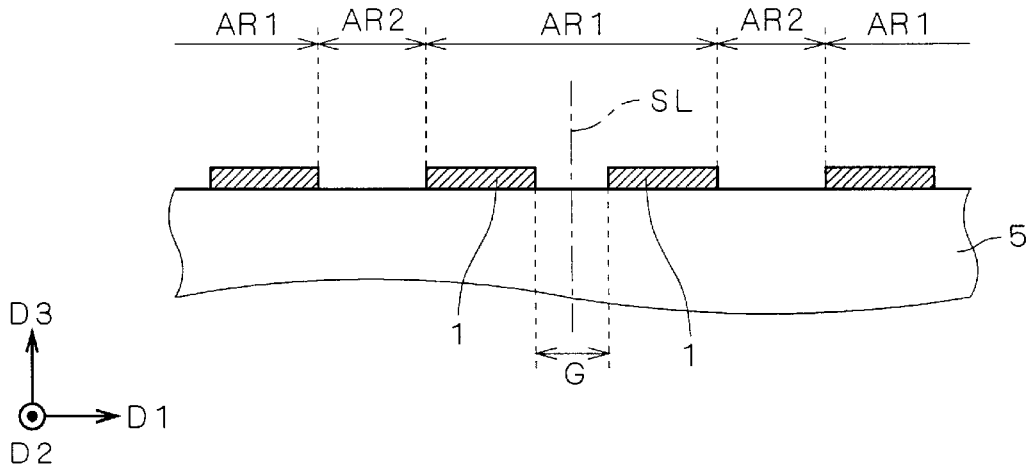
Figure 5:
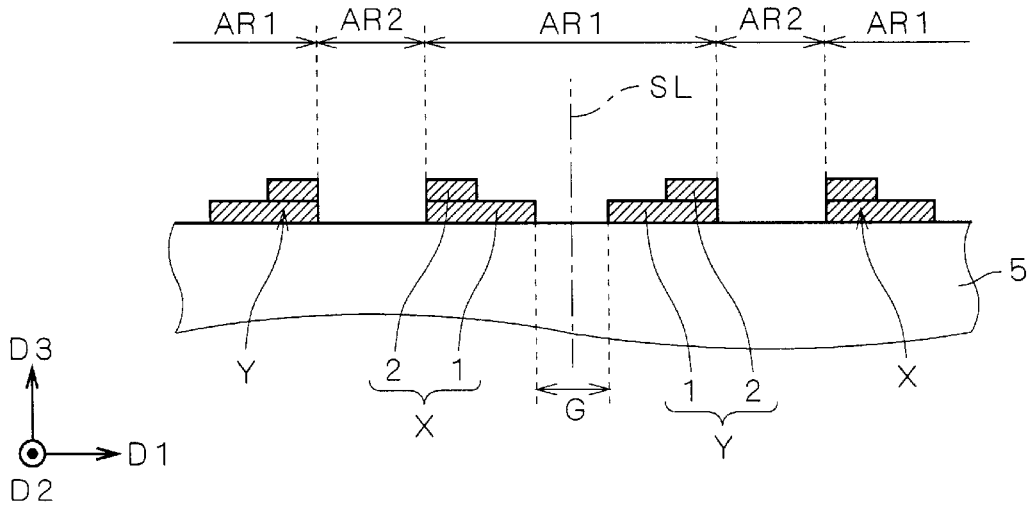
Figure 6:
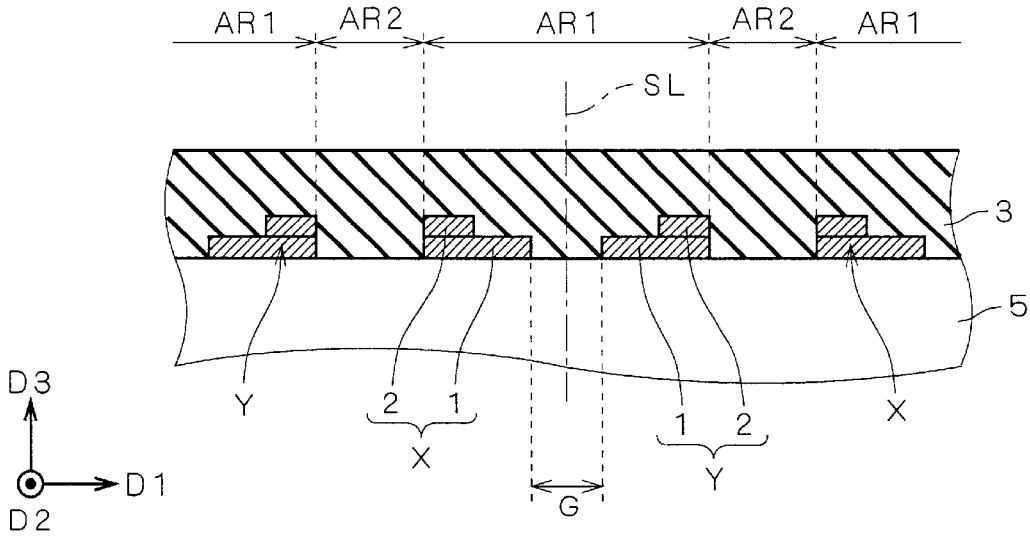
Figure 7:
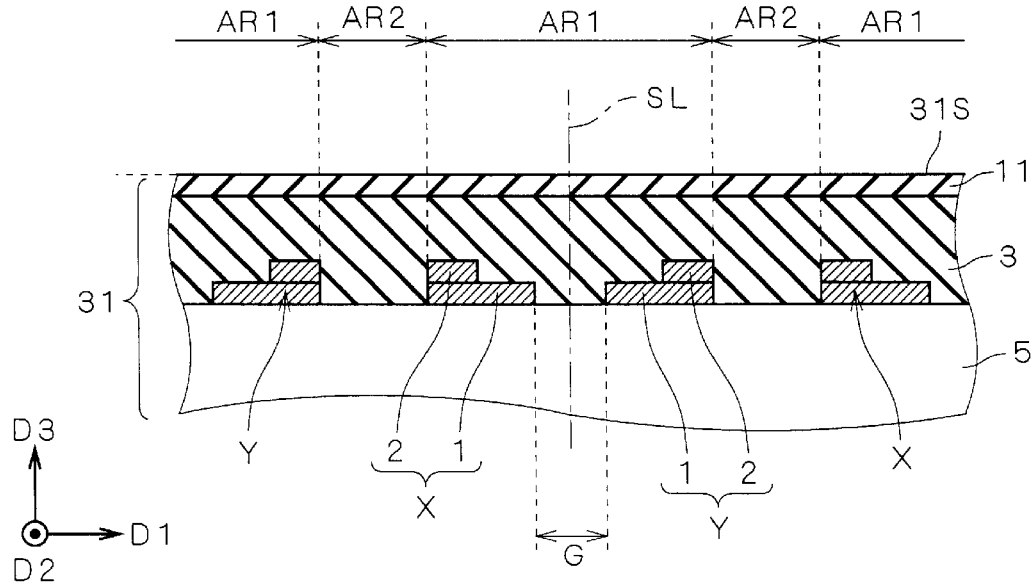

First, the front glass substrate 5 is prepared (see FIG. 3), and the transparent electrodes 1 are formed in the striped pattern on a first main surface (corresponding to the above-mentioned main surface on the rear panel 51R side) of the front glass substrate 5 (see FIG. 4). The transparent electrodes 1 are formed by, for example, ITO (indium tin oxide) sputtering. Next, the bus electrodes 2 are formed on the transparent electrodes 1 respectively, for example, by evaporation (see FIG. 5). Then, a dielectric paste is applied to the entire main surface of the front glass substrate 5 to cover the transparent electrodes 1 and the bus electrodes 2, that is, the electrodes X and Y. The dielectric paste is dried and fired (or burned) to form the dielectric layer 3 (see FIG. 6). The cathode film 11 is formed on the exposed surface of the dielectric layer 3, for example, by an evaporation process (see FIG. 7). The substrate 31 is completed by the above-mentioned steps.

Next, a paste for the discharge inhibiting films (or a paste for the PDP) is pattern-printed to provide the front panel 51F1 shown in FIGS. 1 and 2. In particular, the paste for the discharge inhibiting films used herein comprises, for example, a kneaded mixture of: (a) a powder of the above-mentioned discharge inhibiting material such as $TiO_2$ and $Al_2O_3$; (b) a powder of glass material including an electrically insulative metal oxide such as lead oxide (PbO); (c) a resin such as ethyl cellulose; and (d) an organic solvent such as terpineol. In the following description, either only (a) the discharge inhibiting material or both of (a) the discharge inhibiting material and (b) the glass material together are referred to as a "main material."

It is desirable that the powders (or particles) used herein are not greater than about 1 $\mu$m in average particle size. The powders (or particles) used herein may be of various shapes such as spherical and tubular shapes (i.e., of any shape). Further, for example, the main material in the paste is controlled to range from 3 to 50% by weight, and the resin and the solvent are controlled to range from 97 to 50% by weight, thereby controlling the viscosity of the paste to, e.g., 30 to 100 Pa·s. The discharge inhibiting material used herein may be either one of the materials such as $TiO_2$ and $Al_2O_3$ or a mixture thereof. Moreover, the paste which does not comprise the above-mentioned glass material may be used.

Such a paste for the discharge inhibiting films is pattern-printed on the surface 31S of the substrate 31 by using a screen printing process. More specifically, the paste is printed so that a drying process (e.g., at about 150° C. for about ten minutes) after the printing provides the thickness of the paste which ranges from about 3 to about 4 $\mu$m. After the drying process, the paste is fired (e.g., at about 400 to 450° C. for about 20 minutes) to provide the thin-film discharge inhibiting films 21 ranging from about 1.6 to about 2 $\mu$m in thickness. In this process, a greater thickness of the discharge inhibiting films 21 would result in a large clearance between the barrier ribs 47 and the cathode film 11, making it difficult to ensure isolation between the cells arranged in the second direction D2. However, the use of the powders (or particles) which are not greater than about 1 $\mu$m in average particle size for the above-mentioned paste allows the production of the thin-film discharge inhibiting films 21 which range from about 1.6 to about 2 $\mu$m in thickness, as discussed above. Therefore, such thin-film discharge inhibiting films 21 can sufficiently ensure the isolation between the cells.

The front panel 51F1 is completed by the above steps. The rear panel 51R may be manufactured by a variety of known manufacturing methods, which are not described in detail here.

Then, the front panel 51F1 and the rear panel 51R are placed so that the electrodes X, Y and the electrodes 46 intersect at right angles and so that the discharge inhibiting films 21 and the barrier ribs 47 are in abutting engagement with each other, and are then sealed to each other at their peripheries. Thereafter, the discharge spaces 51S are filled with the above-mentioned discharge gas. This completes the PDP 101.

In the methods of manufacturing PDPs, the printing process is typically used to form a thick film having a thickness ranging from about 7 to about 8 $\mu$m since it has been believed to be difficult to form a thin film by the printing process. However, after research and development activity, the inventor of the present invention attained the above-mentioned paste. This has made it possible to form the discharge inhibiting films of the thin-film type by the printing process.

As discussed above, the discharge inhibiting films 21 are formed by printing, drying and firing the paste. This achieves a reduction in costs such as an apparatus cost and a maintenance cost of manufacturing apparatuses, as compared with the conventional evaporation and lift-off process.

Additionally, the above-mentioned manufacturing method in which the paste is pattern-printed does not require process steps for patterning, i.e., the coating, pattern-exposure, development and removal of the resist which have been used in the evaporation and lift-off process. This achieves a significant reduction in the number of process steps, as compared with the conventional evaporation and lift-off process.

Moreover, although the evaporation and lift-off process requires time to make preparations before starting evaporation, e.g. preparations for a vacuum apparatus and the like, the printing process does not substantially require such time. Therefore, the printing process can reduce the time required to form the discharge inhibiting films, as compared with the evaporation and lift-off process.

Consequently, the method of the first preferred embodiment can manufacture the front panel 51F1 and, accordingly, the PDP 101 at low costs. The discharge inhibiting films 21, of course, can suppress the discharge (erroneous discharge) between the cells arranged in the first direction D1, thereby to improve the display quality (image quality).

When the paste for the discharge inhibiting films which does not comprise the above-mentioned glass material is used as discussed above, the discharge inhibiting films 21 after the firing process (see FIG. 2) is in an unsintered state. Sintering includes reactions which entail the bonding and desorption of new oxygen and a reaction which entails the fusion of material particles, whereas firing includes heat treatment which does not entail such reactions. In other words, sintering causes a change in physical properties (or chemical composition) of the powder materials in the paste, whereas firing does not cause the chemical composition change, softening and fusion of the materials themselves such as $TiO_2$ and $Al_2O_3$ although the resin and solvent in the paste may volatilize (in this respect, it is similar to the firing of phosphor materials in the PDP). The discharge inhibiting films 21 which are in the unsintered state absorb mechanical stresses caused to act by the abutting engagement of the barrier ribs 47 with the discharge inhibiting films 21, to prevent damages to the barrier ribs 47, consequently suppressing the occurrence of pixel defects in the PDP 101. Such effects are produced by placing parts of the (exposed) surface of the front panel 51F1 which are to be in abutting engagement with the barrier ribs 47 into the unsintered state, independently of the presence or absence of a discharge inhibiting function.

<First Modification of First Preferred Embodiment>

A first modification of the first preferred embodiment illustrates a method of patterning the discharge inhibiting films 21 by using a photolithographic process.

Figure 8:
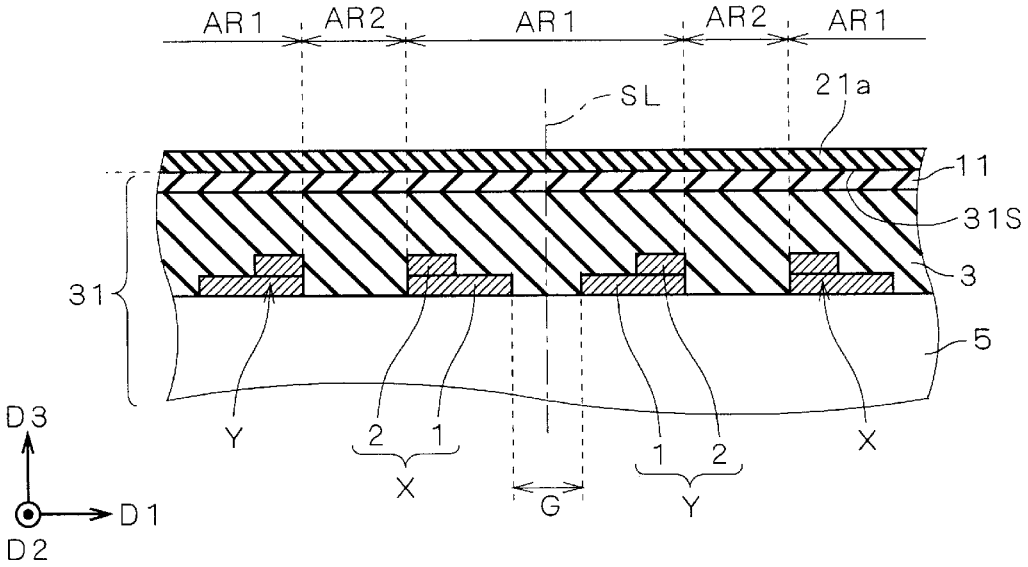
FIGS. 8 and 9 are schematic sectional views for illustrating a method of manufacturing the front panel according to a first modification of the first preferred embodiment.

First, the above-mentioned paste 21*a* for the discharge inhibiting films is applied to the entire surface 31S of the substrate 31 by a printing process, and is then dried (see FIG. 8).

Figure 9:
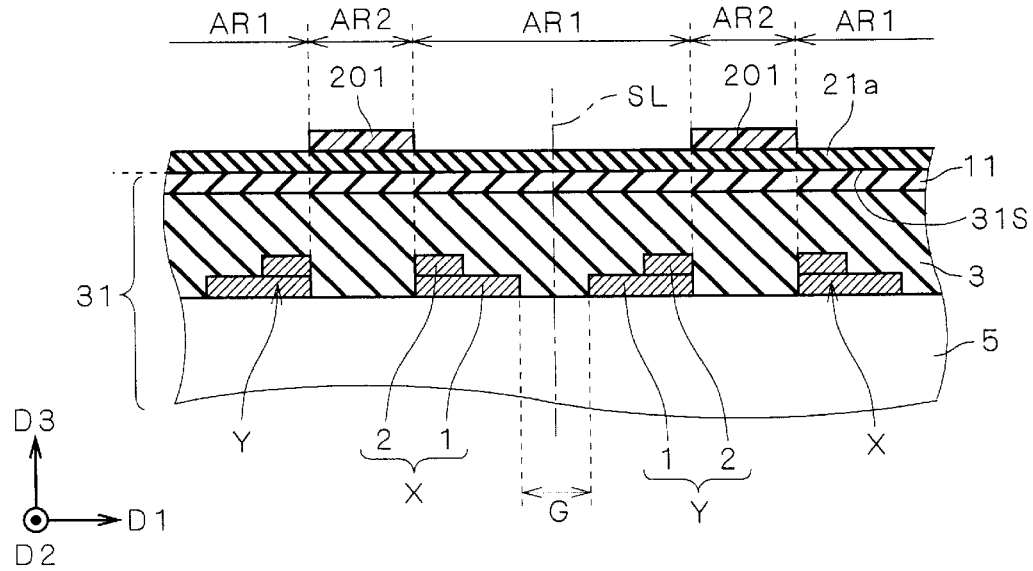

Thereafter, a resist is placed on the entire surface of the paste 21*a*, for example, by coating with (liquid) resist or affixing a dry film resist. Then, pattern exposure and development are performed so that parts of the resist in the area AR2 remain as resists 201 (see FIG. 9).

Using the resists 201 as a mask, the paste 21*a* is patterned using, e.g., sandblast. The patterned paste is fired to provide the discharge inhibiting films 21 (see FIG. 2).

In this manufacturing method, the discharge inhibiting films 21 are patterned by the photolithographic process using the resist, but are formed by the printing process. Therefore, even this manufacturing method can achieve a further cost reduction, as compared with a method of forming the discharge inhibiting films by the evaporation process. Additionally, the photolithographic process is better in rectilinear property of pattern edges and in position accuracy with respect to the electrodes X and Y than the pattern printing process, and therefore is more advantageous in process margin.

<Second Modification of First Preferred Embodiment>

The use of a photosensitive resin, e.g. methyl acrylate, in place of the ethyl cellulose or the like, for the paste for the discharge inhibiting films allows the patterning of the paste by the photolithographic process without using the resist. Firing the patterned paste produces the discharge inhibiting films 21. Such a manufacturing method does not require the resist and the process steps associated with the resist, to accordingly achieves further cost reduction than the method of the first modification.

<Third Modification of First Preferred Embodiment>

A third modification of the first preferred embodiment illustrates a method of patterning the discharge inhibiting films 21 by using a lift-off process.

Figure 10:
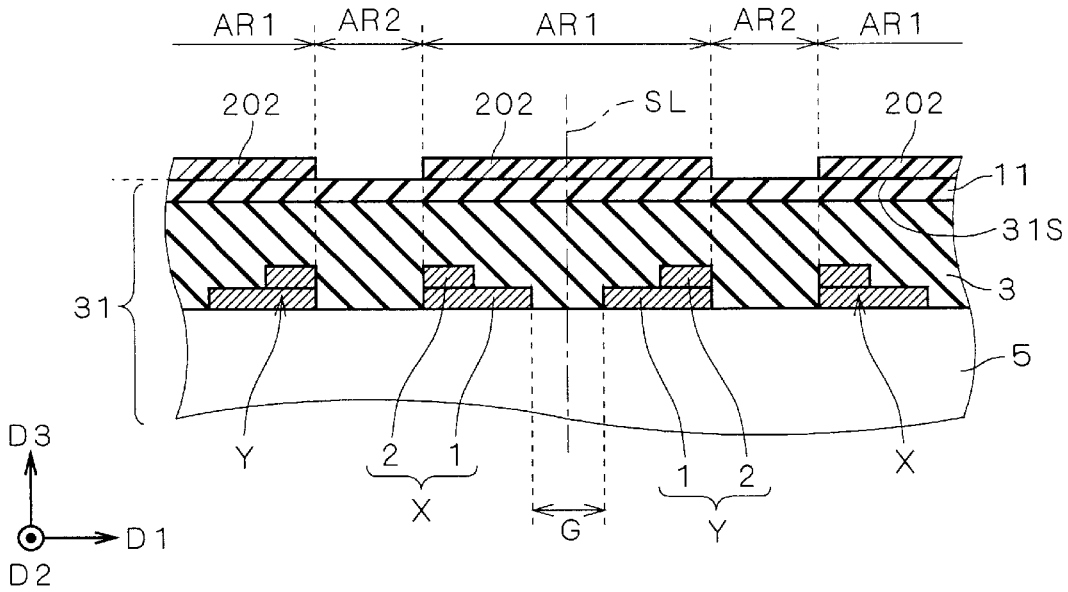
FIGS. 10 and 11 are schematic sectional views for illustrating a method of manufacturing the front panel according to a third modification of the first preferred embodiment.

First, as in the first modification, the resist is placed on the entire surface 31S of the substrate 31. Then, pattern exposure and development are performed so that parts of the resist in the area AR1 remain as resists 202 (see FIG. 10).

Figure 11:
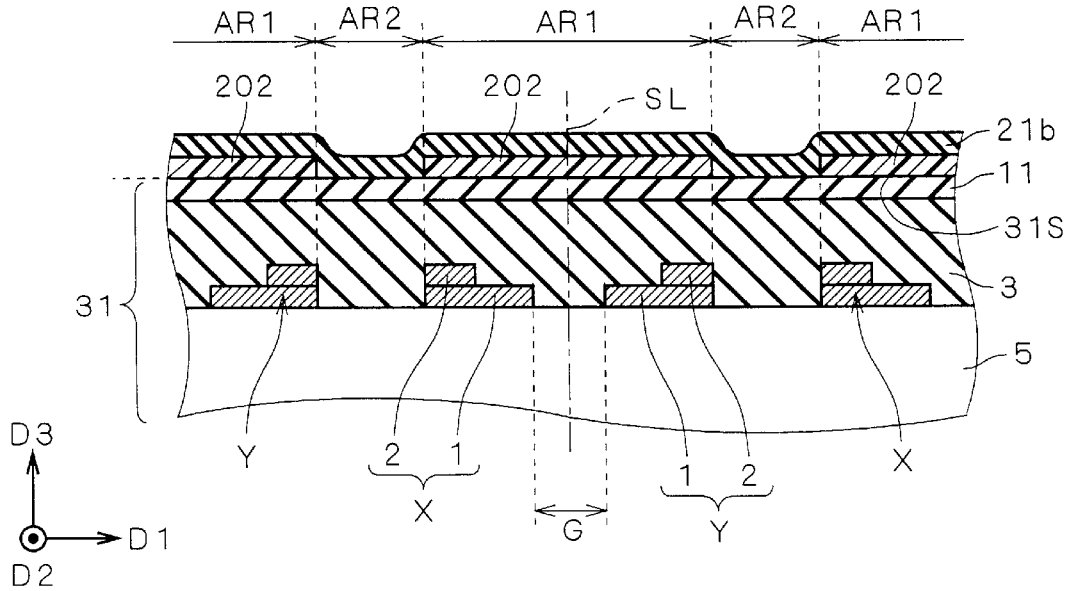

Next, a paste 21*b* for the discharge inhibiting films is applied to the entire surface 31S of the substrate 31 by a printing process to cover the resists 202, and is then dried (see FIG. 11). Thereafter, parts of the paste 21*b* lying on the resists 202 are removed at the same time that the resists 202 are removed, and the remaining paste in the area AR2 is fired. This provides the discharge inhibiting films 21 (see FIG. 2).

In this manufacturing method, the discharge inhibiting films 21 are patterned by the lift-off process, but are formed by the printing process. Therefore, even this manufacturing method can achieve the further cost reduction, as compared with a method of forming the discharge inhibiting films by the evaporation process.

<Fourth Modification of First Preferred Embodiment>

The discharge inhibiting films 21 may be formed by a dispenser process using the above-mentioned paste in place of the printing process. In such a case, the use of a nozzle or the like which conforms to the pattern width of the discharge inhibiting films 21 allows the direct formation (drawing) of the pattern of the discharge inhibiting films 21 without the use of the photolithographic process. Additionally, high efficiency of utilization of the paste achieves a significant cost reduction. Therefore, also the dispenser process can manufacture the front panel 51F1 and the PDP 101 at lower costs than can the evaporation and lift-off process.

<Fifth Modification of First Preferred Embodiment>

The discharge inhibiting films 21 may be formed by a coater (a batch-type coating apparatus) using the above-mentioned paste. In such a case, the paste is transferred onto the substrate 31, for example, through a sponge-like roll or a nozzle with a slit.

The coater is capable of coating a larger area, e.g. the entire surface 31S, with the paste having a more uniform film thickness (with variations in film thickness suppressed) than the printing process. Furthermore, although the printing process is disadvantageous in that mesh marks of a screen are left as surface irregularities, the coater can avoid such irregularities.

<Sixth Modification of First Preferred Embodiment>

The above-mentioned paste may be previously placed on a sheet and dried to some degree or increased in viscosity, thereby to be used in the form of a so-called dry film. In this case, the paste may be placed on the sheet over an area large enough to cover the entire surface 31S of the substrate 31 or may be placed in the pattern of the discharge inhibiting films 21. When placing the paste in the pattern of the discharge inhibiting films 21, the above-mentioned patterning process such as the photolithographic process may be employed. The paste in the form of a dry film is placed on the substrate 31 by a laminator (or an affixing apparatus).

The use of the paste in the form of the dry film can reduce the time required to form the discharge inhibiting films, as compared with not only the evaporation and lift-off process but also the printing process and the like. Therefore, this method can manufacture the front panel 51F1 and the PDP 101 at lower costs.

Thus, the use of the paste increases the flexibility of the method of forming the discharge inhibiting films 21 as described in the first preferred embodiment and the first to sixth modifications thereof.

<Second Preferred Embodiment>

Figure 12:
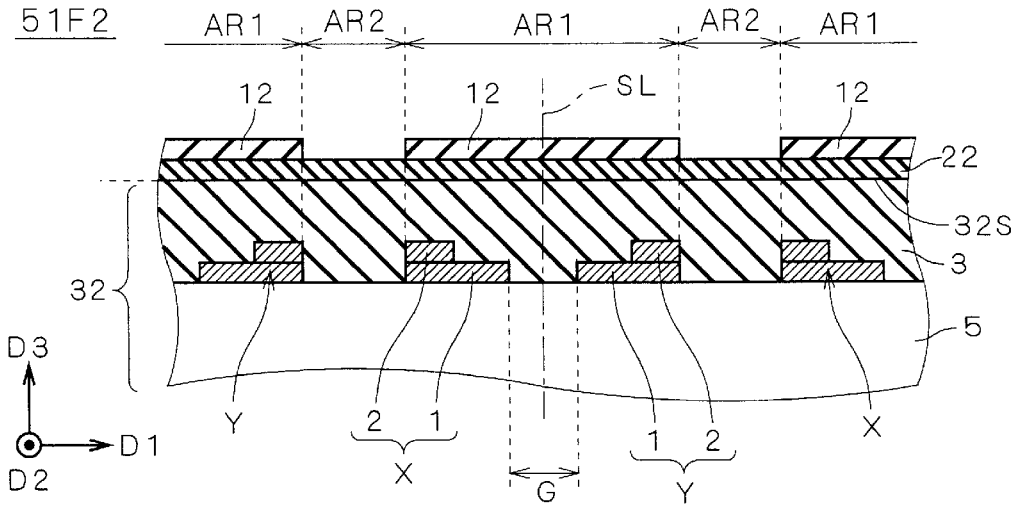
FIG. 12 is a schematic sectional view of the front panel according to a second preferred embodiment of the present invention.

FIG. 12 is a schematic sectional view of a front panel 51F2 according to a second preferred embodiment of the present invention. In the following description, like reference numerals and characters are used to designate components similar to those described above, thereby to quote the detailed description thereof. As shown in FIG. 12, the front panel 51F2 comprises a substrate (or a substrate having electrodes) 32, a discharge inhibiting film 22, and cathode films 12.

More particularly, the substrate 32 comprises the front glass substrate 5, the electrodes X and Y, and the dielectric layer 3. A surface of the dielectric layer 3 opposite from the front glass substrate 5 corresponds to a surface 32S of the substrate 32.

The discharge inhibiting film 22 is disposed on the entire surface 32S of the substrate 32, and each of the cathode films 12 is disposed in the area AR1 on the opposite surface of the discharge inhibiting film 22 from the surface 32S. In other words, part of the discharge inhibiting film 22 which lies in the area AR2 is exposed. Although an area in which the discharge inhibiting film 22 is exposed as seen in plan view of the surface 32S is shown in FIG. 12 in non-overlapping relationship with the electrodes X and Y, an area in which the cathode films 12 are formed may be reduced so that the exposed area of the discharge inhibiting film 22 overlaps the electrodes X and/or the electrodes Y.

Figure 13:
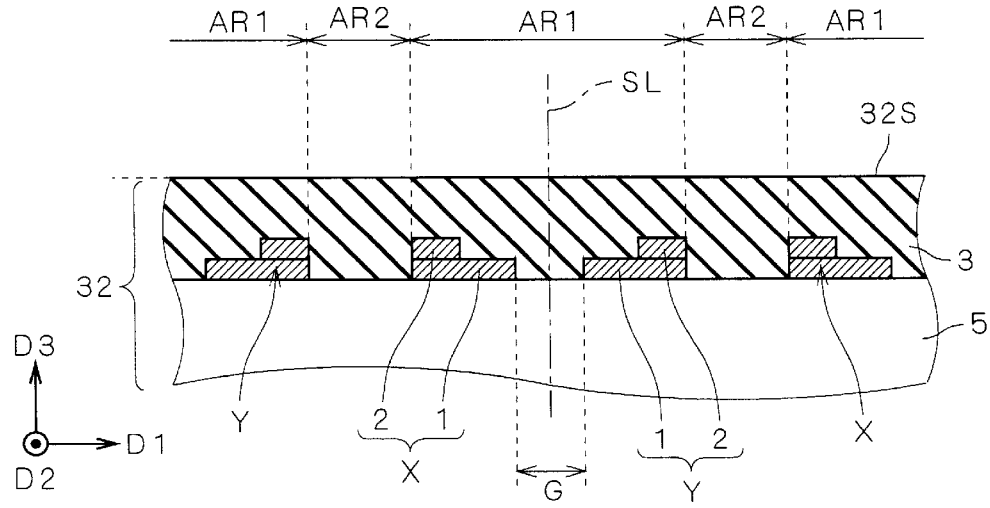
FIGS. 13 and 14 are schematic sectional views for illustrating a method of manufacturing the front panel according to the second preferred embodiment.
Figure 14:
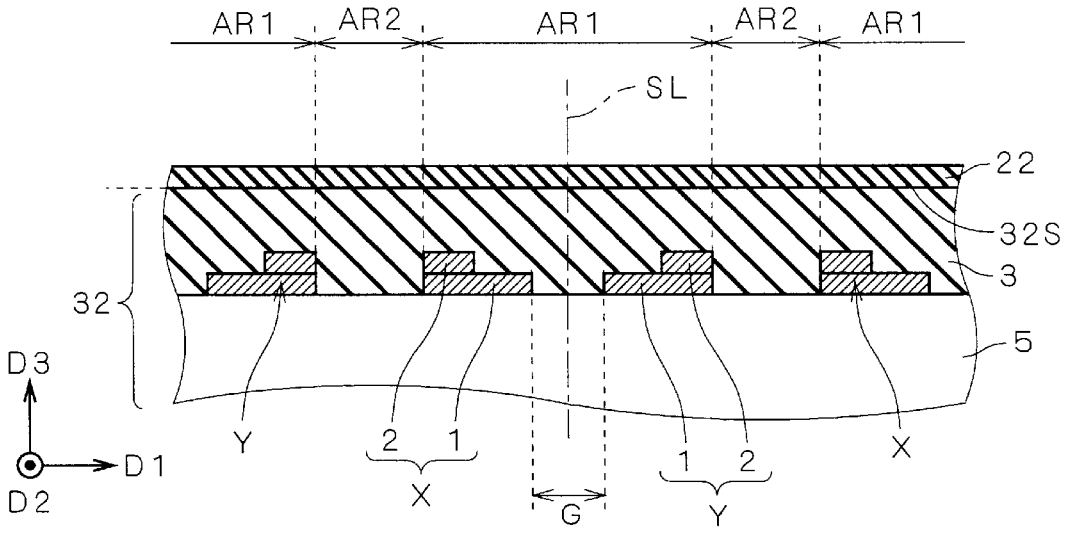

Next, description will now be given on a method of manufacturing the front panel 51F2 with reference to schematic sectional views of FIGS. 13 and 14 in addition to FIG. 12. First, the transparent electrodes 1, the bus electrodes 2 and the dielectric layer 3 are formed to prepare the substrate 32 by the above-mentioned manufacturing method (see FIG. 13). Then, a paste for the discharge inhibiting film is placed on the entire surface 32S by a printing process or the like. The paste is dried and fired to produce the discharge inhibiting film 22 (see FIG. 14). Thereafter, each of the cathode films 12 is formed in the area AR1 on the exposed surface of the discharge inhibiting film 22, for example, by an evaporation and lift-off process (see FIG. 12).

This manufacturing method also employs the paste to form the discharge inhibiting film 22, thereby producing effects similar to those of the first preferred embodiment and the first modification thereof and the like.

Further, the cathode films 12 are formed in the final step of the method of manufacturing the front panel 51F2 according to the second preferred embodiment. In other words, this method does not perform the step of forming other components (e.g. the discharge inhibiting film) after the cathode films 12 are formed. This prevents the deterioration of film quality, e.g. a scratch on the cathode films 12 made by the screen for use in forming the discharge inhibiting film by the printing process. Therefore, the use of the front panel 51F2 provides a PDP of high display quality having the good-quality cathode films.

<First Modification of Second Preferred Embodiment>

Figure 15:
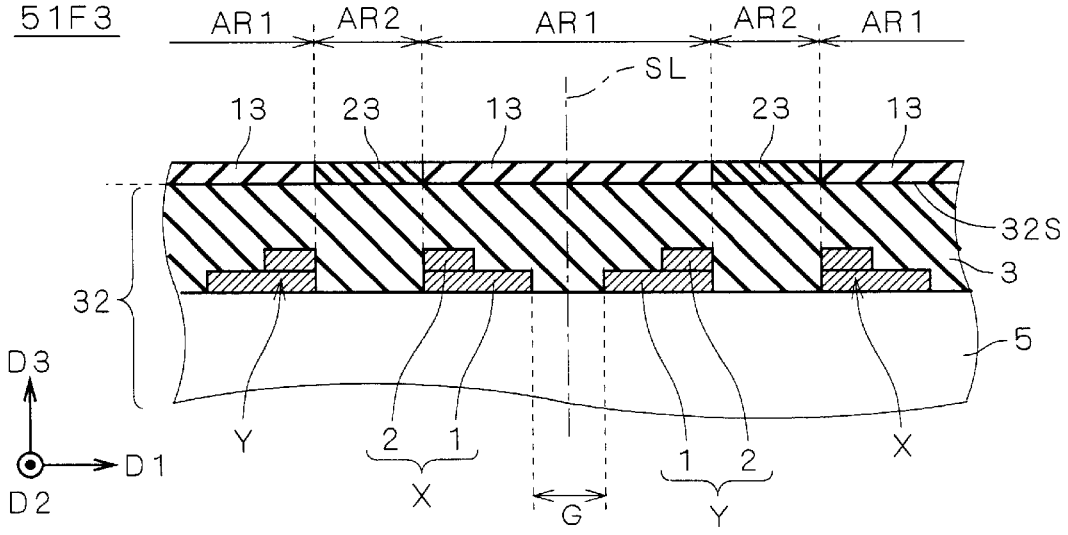
FIG. 15 is a schematic sectional view of the front panel according to a first modification of the second preferred embodiment.

FIG. 15 is a schematic sectional view of a front panel 51F3 according to a first modification of the second preferred embodiment. As shown in FIG. 15, the front panel 51F3 comprises the substrate 32, discharge inhibiting films 23, and cathode films 13. More particularly, each of the discharge inhibiting films 23 is disposed in the area AR2 on the surface 32S of the substrate 32, and each of the cathode films 13 is disposed in the area AR1 on the surface 32S.

The discharge inhibiting films 23 and the cathode films 13 may be formed by the above-mentioned film formation process or by a combination of the film formation process and the patterning process, to produce the above-mentioned effects resulting from the manufacturing method.

In this method, either of the discharge inhibiting films 23 and the cathode films 13 may be formed earlier. However, forming the cathode films 13 in the final step produces effects similar to those of the second preferred embodiment.

<Third Preferred Embodiment>

Figure 16:
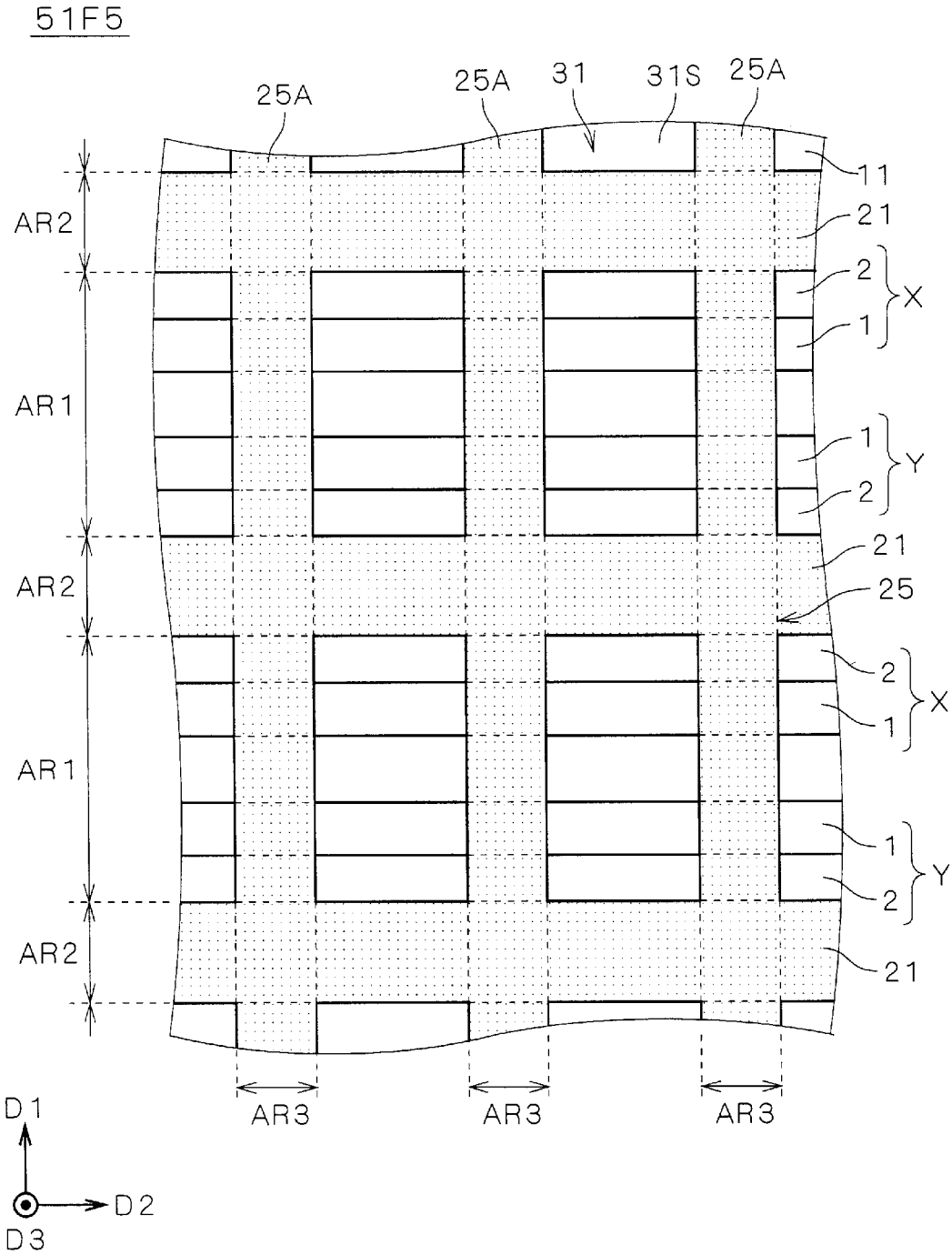
FIG. 16 is a schematic plan view of the front panel according to a third preferred embodiment of the present invention.

FIG. 16 is a schematic plan view of a front panel 51F5 according to a third preferred embodiment of the present invention. FIG. 16 corresponds to a plan view of the front panel 51F5 as viewed from above a discharge inhibiting film 25. The front panel 51F5 features the shape of the discharge inhibiting film 25, and therefore will be described with particular emphasis on this feature.

As shown in FIG. 16, the front panel 51F5 comprises the discharge inhibiting film 25 formed in a lattice pattern on the surface 31S of the substrate 31. More particularly, the discharge inhibiting film 25 comprises the above-mentioned discharge inhibiting films 21 of the front panel 51F1 (see FIGS. 1 and 2), and a plurality of strip-shaped discharge inhibiting films 25A each extending in the first direction D1 on the surface 31S. Intersecting parts of the lattice pattern are shared between the discharge inhibiting films 21 and 25A.

In particular, when the front panel 51F5 and, for example, the above-mentioned rear panel 51R (see FIG. 1) constitute a PDP, the discharge inhibiting films 25A are disposed on the surface 31S in areas AR3 (including three-dimensional areas, like the area AR2 and the like) to be face-to-face with the barrier ribs 47, respectively. Regions of the surface 31S which are to be face-to-face with the substantially U-shaped opening top parts of the phosphor layer 48 may be included in the areas AR3, in which case regions of the surface 31S for abutting engagement with the rear panel 51R in the absence of the discharge inhibiting film 25 and their extended regions in the third direction D3 correspond to the areas AR3. The areas AR3 may be regarded as areas lying between cells arranged in the second direction D2.

The discharge inhibiting film 25 and the cathode film 11 may be formed by the above-mentioned film formation process or by a combination of the film formation process and the patterning process, to produce the above-mentioned effects resulting from the manufacturing method.

In the PDP comprising the front panel 51F5, the discharge inhibiting films 21 are disposed between the cells arranged in the first direction D1 and the discharge inhibiting films 25A are in abutting engagement with the barrier ribs 47. Therefore, the discharge inhibiting films 25A can close the clearance formed between the barrier ribs 47 and the front panel 51F1 in the PDP 101 (see FIG. 1) which does not comprise the discharge inhibiting films 25A. This prevents leakage of discharge through the clearance, to ensure isolation between the cells arranged in the second direction D2, thereby improving image quality. Such an effect is also produced if the discharge inhibiting films 25A are thick.

<Fourth Preferred Embodiment>

The colored or transparent discharge inhibiting films 21–23 and 25 may be provided by selecting the materials of the above-mentioned paste for the discharge inhibiting film and the percentage of the materials by weight or by adding a pigment to the paste. The pigment to be added may include either a single pigment or two or more pigments.

For example, addition of an inorganic oxide such as ruthenium oxide to the paste produces the black-colored discharge inhibiting films 21–23 and 25. The black-colored discharge inhibiting films 21, 23 and 25 which are disposed in the respective areas between adjacent cells can improve the contrast of the PDP. Further, parts of the discharge inhibiting film 22 of FIG. 12 which correspond to the discharge inhibiting films 21 may be colored black to improve the contrast of the PDP.

In general, the tops of the barrier ribs 47 for abutting engagement with the front panel 51F1 and the like are prone to become chipped. Then, coloring the tops of the barrier ribs 47 and the discharge inhibiting films 21–23 and 25 black allows the discharge inhibiting films 21–23 and 25 to prevent the reduction in contrast even if the tops of the barrier ribs 47 become chipped. Further, coloring the discharge inhibiting film in the lattice pattern black eliminates the need to color the tops of the barrier ribs 47 black.

As another example, addition of coarse-grained $TiO_2$, $Al_2O_3$ or the like to the paste produces the white-colored discharge inhibiting films 21–23 and 25. Since the white-colored discharge inhibiting films 21–23 and 25 can reflect light (visible light) generated in the cells, the light may be repeatedly reflected within the cells and thereafter led out of the PDP in the form of display light. This improves the brightness of the PDP. In this case, although the discharge inhibiting films 21–23 and 25 colored other than white can achieve the brightness increased to some degree, white is more preferable which absorbs less visible light or has a higher reflectivity.

It is desirable that the powders in the paste for the discharge inhibiting film are not greater than 1 μm in average particle size for the purpose of reduction in thickness of the discharge inhibiting films 21–23 and 25 as described above, whereas the powders are preferably greater in particle size for the purpose of whitening (or coloring) the paste. Then, the paste may contain the powders having an average particle size of not less than 1 μm for the purpose of whitening (or coloring) the paste. Even in such a case, the thickness reduction and the whitening may be made mutually compatible by controlling the amount of powder having a particle size of not less than 1 μm.

As still another example, the reduction in percentage by weight of the colored materials (such as $TiO_2$) contained in the discharge inhibiting films 21–23 and 25 allows the discharge inhibiting films 21–23 and 25 to be made transparent (or to be made higher in visible light transmittance).

Alternatively, fine-grained powders (preferably not greater than about 0.5 μm in particle size) may be added to the paste for the discharge inhibiting film to increase the transparency of the discharge inhibiting films 21–23 and 25. Such powders have a particle size close to a visible light band or below to weaken a scattering of light from the particle surface, thereby increasing the transmittance (or transparency) of the discharge inhibiting films 21–23 and 25 and, accordingly, the light output opening rate (or light output efficiency) of the PDP. This allows the light generated in the display cells to be led out through the discharge inhibiting films 21–23 and 25, thereby to improve the brightness of the PDP.

While the invention has been described in detail, the foregoing description is in all aspects illustrative and not restrictive. It is understood that numerous other modifications and variations can be devised without departing from the scope of the invention.

What is claimed is:

1. A method of manufacturing a plasma-display-panel-substrate including a discharge inhibitor disposed on a surface of a substrate having electrodes for inhibiting formation of discharge in a plasma display panel, said method comprising the steps of:

(a) placing a paste for said discharge inhibitor on said surface of said substrate having said electrodes; and (b) firing said paste to form said discharge inhibitor, wherein said paste includes a discharge inhibiting material having an average particle size, of not greater than about 1 μm.

2. A method of manufacturing a plasma-display-panel-substrate including a discharge inhibitor disposed on a surface of a substrate having electrodes for inhibiting formation of discharge in a plasma display panel, said method comprising the steps of:

(a) placing a paste for said discharge inhibitor on said surface of said substrate having said electrodes; and (b) firing said paste to form said discharge inhibitor, wherein said discharge inhibitor is a material in an unsintered state.

3. The method according to claim 1, wherein said step (a) comprises the step of placing said paste by a printing process.

4. The method according to claim 1, wherein said step (a) comprises the step of placing said paste by a dispenser process.

5. The method according to claim 1, wherein said step (a) comprises the step of placing said paste by a coater.

6. The method according to claim 1, further comprising the step of (c) placing said paste on a predetermined sheet and drying said paste to form a dry film, wherein said step (a) comprises the step of placing said paste in the form of said dry film.

7. The method according to claim 1, wherein said step (a) comprises the step of patterning said paste by a photolithographic process.

8. The method according to claim 1, further comprising the step of (d) forming a cathode film on said surface of said substrate having said electrodes, wherein said step (d) is performed as a final step.

9. The method according to claim 1, wherein the thickness of said discharge inhibitor obtained after firing is approximately 2 μm or less and is deposited by printing.

10. The method according to claim 1, wherein said discharge inhibitor includes an unsintered powder including at least one of $TiO_2$ and $Al_2O_3$.

11. The method according to claim 1, wherein said paste comprises a kneaded mixture of a powder of discharge inhibiting material, a resin, and an organic solvent.

* * * * *